US005468083A

United States Patent [19]

Chesar

[11] Patent Number: 5,468,083

[45] Date of Patent: Nov. 21, 1995

[54] INSTRUMENT HAND GRIP

[76] Inventor: David M. Chesar, 286 S. 4th St., Byesville, Ohio 43723

[21] Appl. No.: 181,826

[22] Filed: Jan. 18, 1994

[51] Int. Cl.[6] ..... B43K 23/00

[52] U.S. Cl. ..... 401/6; D19/41; D19/46; D19/55; 15/437; 15/443; 401/88; 401/91

[58] Field of Search ..... 401/6, 7, 34, 88, 401/91; 15/443, 437; D19/54, 55, 41, 42, 46, 51

[56] References Cited

U.S. PATENT DOCUMENTS

| | | | |
|---|---|---|---|
| D. 11,953 | 8/1880 | Gerow | D19/46 X |
| 249,893 | 11/1881 | Bulkeley | 401/88 |
| D. 298,551 | 11/1988 | Bright | 401/6 X |
| D. 306,177 | 2/1990 | Park | D19/41 X |
| D. 318,293 | 7/1991 | Flowers | D19/46 X |
| D. 319,467 | 8/1991 | Clowes | D19/41 X |
| 564,178 | 7/1896 | Ahrens | 15/443 |
| 722,160 | 3/1903 | Steiger | 401/34 |
| 1,376,115 | 4/1921 | Record | 401/6 |
| 1,395,793 | 11/1921 | Broschart | 401/6 |
| 1,598,873 | 9/1926 | Peterson | 401/6 |
| 2,517,060 | 8/1950 | Villarin | 401/34 |
| 3,947,977 | 4/1976 | Bishop . | |
| 4,030,841 | 6/1977 | Balasty . | |
| 4,037,975 | 7/1977 | Huffman | 401/6 |
| 4,076,427 | 2/1978 | Anderson . | |
| 4,149,811 | 4/1979 | Coffman . | |
| 4,167,347 | 9/1979 | Hoyle . | |
| 4,269,529 | 5/1981 | McCoullough . | |
| 4,302,121 | 11/1981 | Kim . | |
| 4,306,818 | 12/1981 | Manusch . | |
| 4,508,464 | 4/1985 | Money | 401/6 |
| 4,526,547 | 7/1985 | Rusk . | |
| 4,689,020 | 8/1987 | Rusk . | |
| 4,762,493 | 8/1988 | Anderson . | |
| 5,143,463 | 9/1992 | Pozil et al. | 401/6 |

FOREIGN PATENT DOCUMENTS

| | | | |
|---|---|---|---|
| 542662 | 8/1922 | France | 401/6 |
| 1016159 | 9/1957 | Germany | 401/6 |
| 9562 | of 1895 | United Kingdom | 401/6 |

OTHER PUBLICATIONS

"Veggie Pens" Harriet Carter Oct. 1992.

*Primary Examiner*—Steven A. Bratlie

*Attorney, Agent, or Firm*—Frank H. Foster; Kremblas, Foster & Millard

[57] ABSTRACT

A writing instrument hand grip to facilitate gripping ease and comfort and to improve handwriting for people with a hand and finger dexterity disability. A pyramidal tetrahedron has a writing material detachably mounted to one or more of its apexes. Its faces may be concavely contoured and provided with friction enhancing surfaces.

12 Claims, 4 Drawing Sheets

INSTRUMENT HAND GRIP

Technical Field

This invention relates generally to manually held instruments and more particularly relates to a hand grip for a writing instrument which is useful for assisting in the teaching of handwriting skills and for facilitating the use of a handwriting instrument by children or people having a hand motor skill disability.

Background Art

Despite the prominence of printing and computers, handwriting remains an important and useful skill, and manual writing instruments remain important tools. Most writing instruments comprise an elongated tube containing a writing material, such as pencil lead or ink, and having an end at which the writing material is exposed for contact with the writing surface, such as paper. Handwriting skills are usually taught beginning in kindergarten or first grade. Most children experience some degree of difficulty in gripping small, tubular adult writing instruments because their manual dexterity skills are insufficiently developed. In addition, some children and some adults suffer from a motor skill disability which makes grasping the tubular writing instrument difficult. It is not uncommon for victims of a stroke, cerebral palsy, hand or head traumas or other physical injuries or arthritis to experience some difficulty in grasping and using a writing instrument.

There is therefore a need for a writing instrument hand grip which can facilitate the use of the writing instrument. There is a further need for such a hand grip which will assist in the improvement of grip patterns and handwriting skills of children and others suffering such a disability.

A variety of structural features have been suggested in the past to assist a user in manually gripping a writing instrument. Several patents show various forms of a triangular cross-section along a substantial portion of the length of a tubular writing instrument to provide finger grips upon which the tips of the fingers may be seated. Such patents include U.S. Pat. Nos. 4,030,841; 4,167,347; 4,302,121; and 4,762,493. Swirled or helical variations of such a triangular cross-section are illustrated in U.S. Pat. Nos. 4,076,427 and 4,149,811. A shorter, more discrete variation is the finger grip of Rusk as shown in U.S. Pat. Nos. 4,526,547 and 4,689,020, while a very different finger grip for the handle of an inking pen is shown in U.S. Pat. No. 4,269,529.

U.S. Pat. No. 3,947,977 shows a hand engaging structure for attachment to a writing instrument which has a smoothly contoured surface for engaging the palm and fingers of the users hand. U.S. Pat. No. 4,306,818 shows a conically shaped structure, somewhat resembling a toy animal, and having a writing device mounted to it.

Although such devices are useful for improving the comfort and grip of a user having substantial manual dexterity, they are not of substantial assistance to individuals having less developed motor skills and finger dexterity.

It is therefore an object and feature of the present invention to provide a writing instrument hand grip which facilitates the use of a writing instrument for writing by individuals with less developed skills.

Another object of the invention is to provide a hand grip which facilitates the use of other manually held instruments such as toothbrushes, paintbrushes or silverware.

Brief Disclosure Of Invention

The invention is a pyramidal shaped polyhedron forming the grip and having a writing material protruding at one or more of its apexes. The writing material is detachably mounted to the polyhedron, and preferably the polyhedron is an equilateral, tetrahedral pyramid. Other instruments may be substituted for the writing material.

Figure 1:
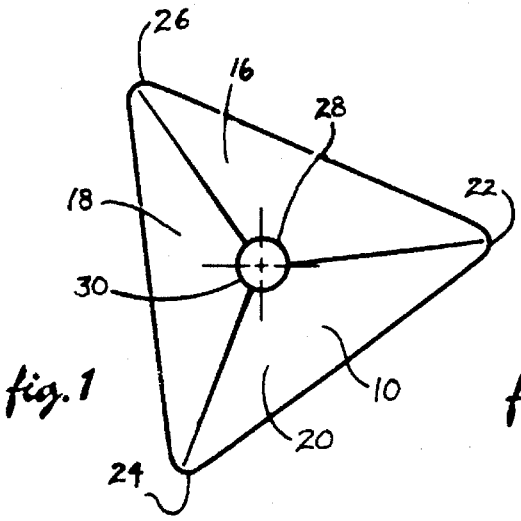
FIG. 1 is a bottom view of the preferred embodiment of the invention.
Figure 2:
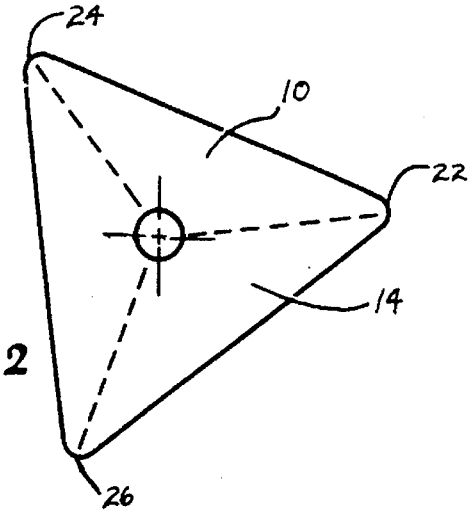
FIG. 2 is a top view of the preferred embodiment of the invention.
Figure 3:
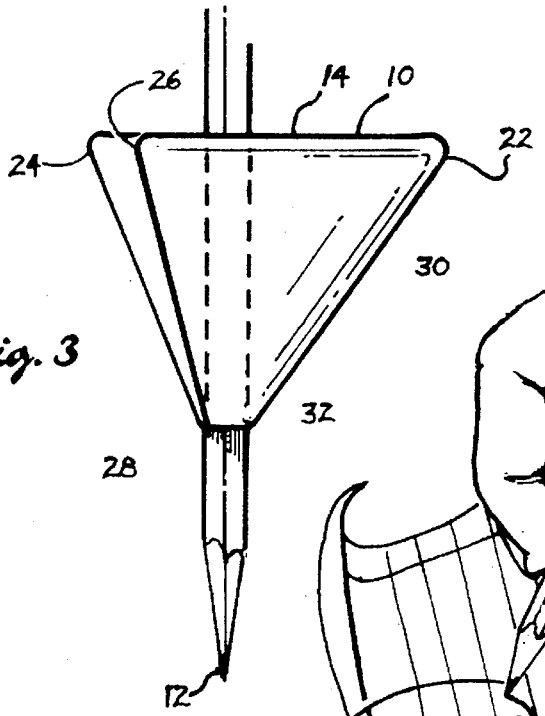
FIG. 3 is a view in side elevation of the embodiment of FIG. 1 in which a pencil is slidably mounted.
Figure 4:
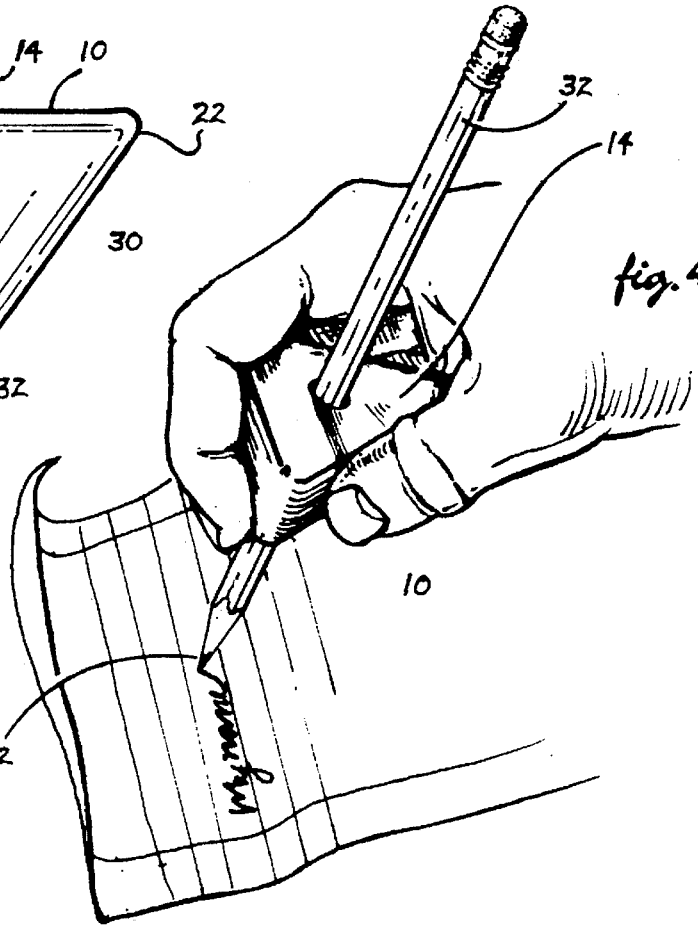
FIG. 4 illustrates the grasping and use of the embodiment of FIG. 1 for handwriting.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

FIGS. 1–4 illustrate the preferred embodiment of the invention. The writing instrument hand grip embodying the present invention is a pyramidal polyhedron 10 having a writing material 12 protruding from an apex. Preferably the polyhedron is an equilateral tetrahedral pyramid, as illustrated. This tetrahedral, pyramidal polyhedron has a top face 14 and side faces 16, 18 and 20. It also has four apexes, including three side apexes 22, 24, 26, and a bottom apex 28.

These apexes are joined by edges at which the faces intersect. The edges are preferably approximately two inches long so that there is approximately two inches between neighboring apexes of the polyhedron. However, the size of the polyhedron is variable dependent upon the size of the hand of the user. For example, for small children the apexes may be as little as one inch apart, while a spacing between the apexes of three inches is preferable for an adult having a large hand. However, the apexes should be at least approximately one inch apart because a smaller distance between the apexes makes the polyhedron so small that it cannot conveniently be grasped by the hand of the intended users.

The invention contemplates a variety of alternative structures for detachably mounting the writing material to the polyhedron. FIG. 1 illustrates the preferred embodiment in which there is a bore 30 formed entirely through the polyhedron and opening at the apex 28. A writing instrument 32, such as a pencil, is frictionally engaged in the bore 30 to permit slidable adjustment of the polyhedron 10 to the desired position along the length of the writing instrument 32. The preferred bore extends perpendicularly of the top face 14 so that the polyhedron 10 symmetrically surrounds the writing instrument 32. However, multiple intersecting bores may be formed through the polyhedron and the bores may be aligned nonperpendicularly to the face which is opposite the apex through which the bores pass.

Although the polyhedron of the present invention may be uncomfortable for persons with normal finger dexterity who have become accustomed to writing with conventional writing instruments, the polyhedron of the present invention provides a relatively large object which may conveniently be gripped and provides surfaces at relatively large angles to each other to assist a person in grasping and firmly retaining the polyhedral hand grip, including its attached writing material or instrument. Because of the size and shape of the polyhedral grip, neither precise positioning of the finger tips nor a powerful strong grasp is required by the user. This results in part from the acute angle between intersecting faces and the acute angle between intersecting edges which join the apexes. The shape and size of the invention enhances comfort and fit during pick up, manipulation into a writing position, and use writing.

Figure 5:
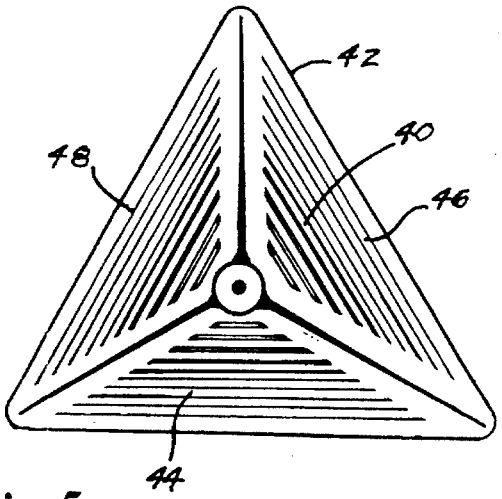
FIG. 5 is a bottom view of an alternative embodiment of the invention including friction enhancing grooves.
Figure 6:
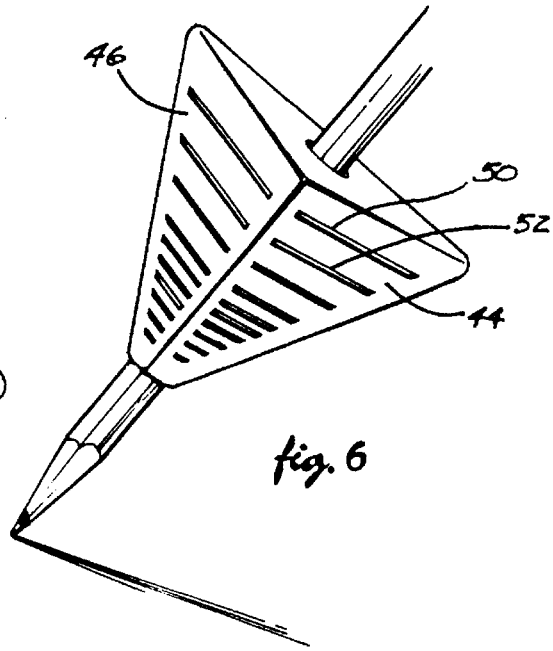
FIG. 6 is a view in perspective illustrating the use of the embodiment of FIG. 5 having a pencil protruding at its lowermost apex.

There are a variety of alternative structural features which may be incorporated into embodiments of the present invention. For example, FIGS. 5 and 6 illustrate the employment of a friction enhancing surface texture 40 formed upon side faces 44, 46 and 48. The surface texture illustrated in FIG. 5 comprises a series of spaced grooves, such as grooves 50 and 52, formed into the side surfaces. A variety of alternative friction enhancing surfaces will be apparent to those skilled in the art. Friction enhancing surfaces would include raised bumps or stippling, knurling, an abrasive surface, or particulate or fibrous material bonded to the faces of the polyhedron.

Figure 7:
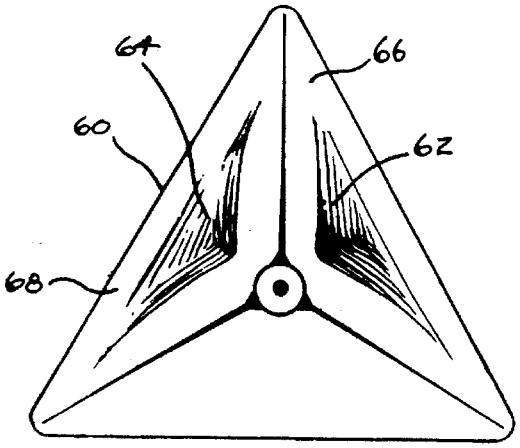
FIG. 7 is a bottom view of yet another alternative embodiment of the invention having concave indentations formed in its faces to further facilitate grasping.
Figure 8:
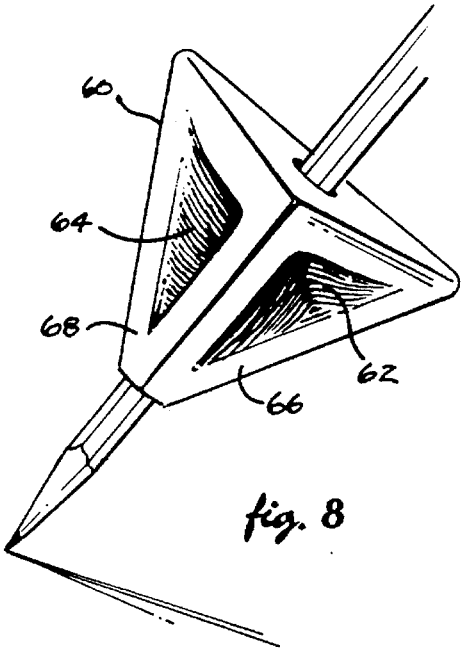
FIG. 8 is a view in perspective of the embodiment of FIG. 7 including a pencil writing instrument.

FIGS. 7 and 8 illustrate a polyhedron 60 having concave indentations or depressions, such as indentations 62 and 64, formed in the faces 66 and 68 of the polyhedron 60.

Figure 10:
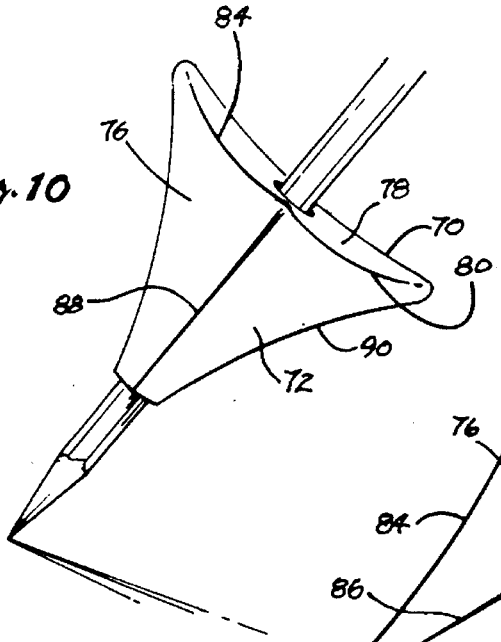
FIG. 10 is a view in perspective of the embodiment of FIG. 9 including a pencil.
Figure 9:
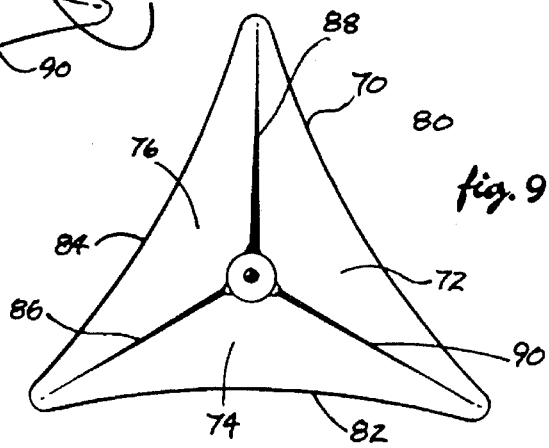
FIG. 9 is a bottom view of yet another alterative embodiment of the invention having concave faces and arcuate edges joining its apexes.

Alternatively, as illustrated in FIGS. 9 and 10, a polyhedron 70 may be formed with concave faces 72, 74, 76 and 78, if desired. These concave faces intersect at arcuately curved edges 80, 82, 84, 86, 88 and 90. These concave surfaces and arcuately curved intersecting edges at the intersecting faces further facilitate gripping by the hand of the user.

Figure 13:
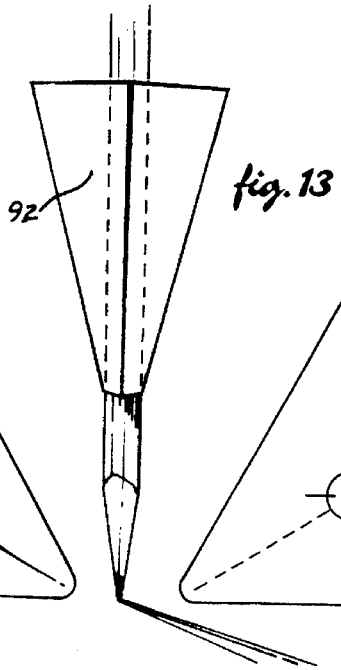
FIG. 13 is a view in perspective of the embodiment of FIG. 11 including a pencil.
Figure 11:
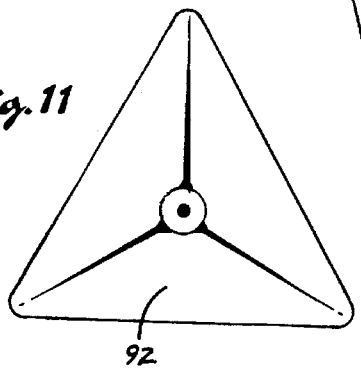
FIG. 11 is a bottom view of an elongated pyramid embodying the present invention and including isosceles triangular faces.
Figure 12:
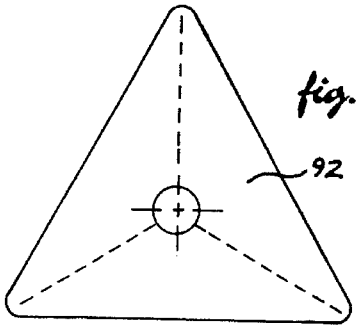
FIG. 12 is a top view of the embodiment of FIG. 11.

It is not necessary that embodiments of the invention all be equilateral pyramids, that is having equilateral triangles on the sides. For the convenient gripping of users who prefer a more elongated grip, an alternative embodiment is illustrated in FIGS. 11, 12 and 13 which has an elongated pyramid 92 having at least three isosceles triangular sides. The preferred elongated pyramid has angles of approximately 30° at the apexes of the triangular side faces. However, it is believed that the angles could be anywhere between 15° and 60°.

Figure 14:
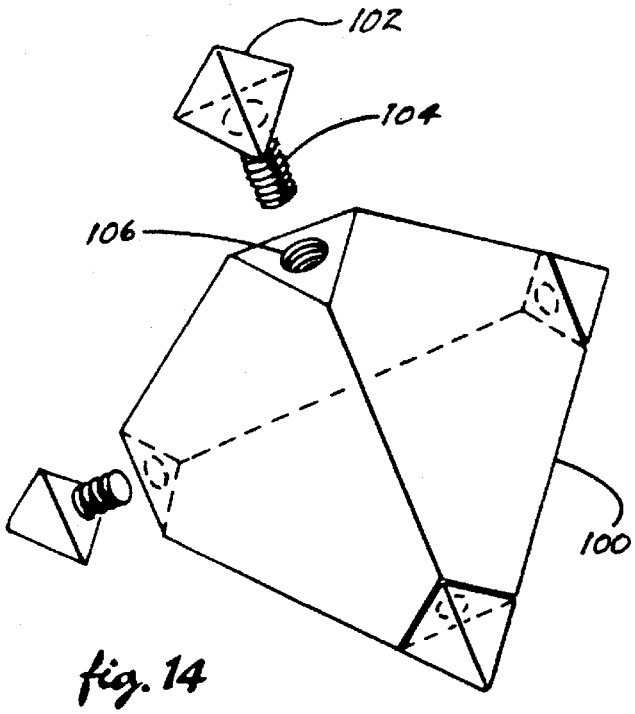
FIG. 14 is a view in perspective of yet another alternative embodiment of the invention in which the writing material is formed into an extension of the shape of the polyhedral pyramid and is detachably mounted at the apexes of the polyhedron.
Figure 15:
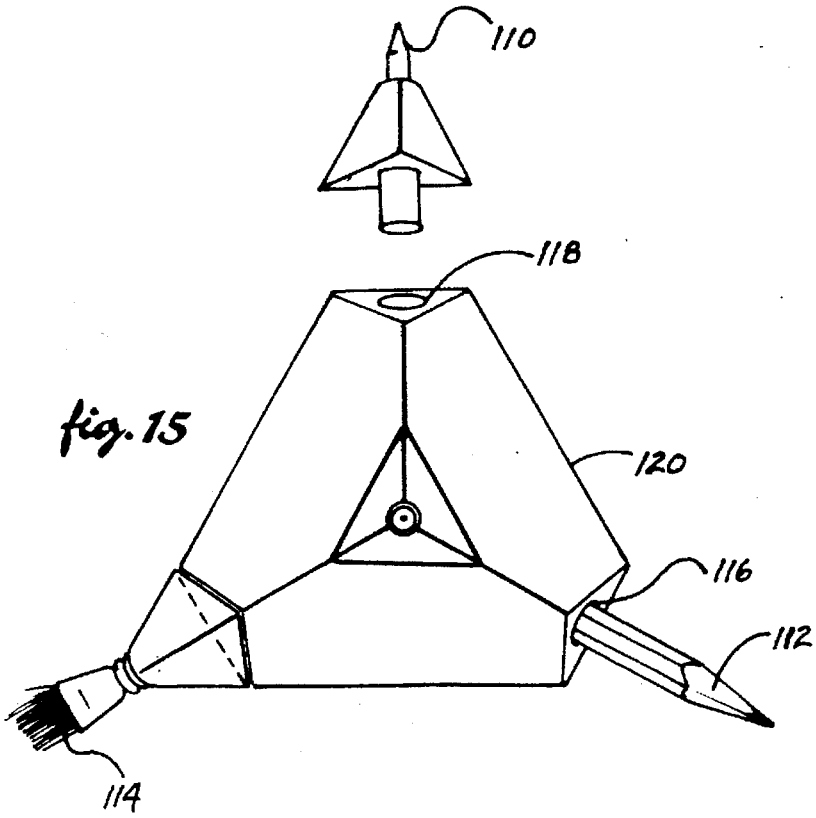
FIG. 15 is a view in perspective of still another alternative embodiment of the invention illustrating the use of various writing-related instruments detachably mounted at the apexes of the polyhedron.

The embodiments illustrated in FIGS. 1–13 all provide a writing material at the apex by inserting an elongated tubular writing instrument into a bore through the polyhedron. FIGS. 14 and 15 illustrate alternative structures in which a variety of different writing materials may be detachably mounted at different apexes of the polyhedron. For example, FIG. 14 illustrates a polyhedron 100 having a variety of different materials, such as chalk, pencil lead, and crayon, or alternatively crayons of differing colors. For example, a small pyramidal piece of crayon 102 may be connected by a threaded shank 104 to a threaded bore 106 formed into an apex of the polyhedron 100. Other materials or other colors of similar materials may be similarly attached to other apexes of the polyhedron 100. An eraser can be similarly mounted at an apex.

One advantage of an equilateral, pyramidal tetrahedron is that a writing material may be positioned at each of its four apexes and it is identically gripped regardless of which writing material is in the bottom writing position.

As another alternative, FIG. 15 illustrates a variety of different writing instruments, such as a pen 110, a pencil 112 and a paint brush 114, mounted, preferably by frictional engagement, into bores, such as bores 116 and 118 in the polyhedron 120. If desired, several additional, interchangeable, different, writing materials or instruments may be provided in a kit for detachable mounting at selected apexes of the polyhedron.

Although a polyhedron embodying the present invention may be formed of a variety of suitable materials such as wood, metal and polymeric resins, a resin polymeric foam is particularly useful because it is lightweight and inexpensive.

Although pyramids may be used having more sides than the preferred embodiment which is illustrated in the drawings, the addition of more sides is believed to substantially reduce the effectiveness and advantageous nature of the invention. At six or more sides the resulting structure would so closely approximate a conical shape and the angles between most of the surfaces and their intersecting edges would be so obtuse that much of the ease with which embodiments of the invention may be securely grasped would be lost.

While certain preferred embodiments of the present invention have been disclosed in detail, it is to be understood that various modifications may be adopted without departing from the spirit of the invention or scope of the following claims.

I claim:

1. A hand grip attachment to a writing instrument for facilitating the manual gripping of the instrument, the attachment comprising: a tetrahedral pyramidal polyhedron attached to the instrument wherein the polyhedron has edges joining apexes, the apexes being spaced at least one inch apart, the polyhedron having substantially flat sides and a base, the writing instrument extending from one of the apexes with said base being opposite the writing instrument.

2. A grip in accordance with claim 1 wherein the polyhedron has faces which have a friction enhancing surface texture for facilitating gripping by a hand.

3. An attachment in accordance with claim 2 wherein the friction enhancing surface texture comprises a series of spaced grooves.

4. An attachment in accordance with claim 1 wherein the polyhedron has a bore opening at an apex for detachably receiving the writing instrument.

5. An attachment in accordance with claim 4 wherein said bore extends entirely through the polyhedron for permitting slidable adjustment of the writing instrument.

6. An attachment in accordance with claim 1 wherein the polyhedron has faces which are concave for facilitating gripping by a hand.

7. An attachment in accordance with claim 6 wherein the polyhedron has arcuately curved edges at intersecting faces.

8. An attachment in accordance with claim 1 wherein concave indentations are formed into faces of the polyhedron.

9. An attachment in accordance with claim 1 wherein the polyhedron is an elongated pyramid having at least 3 isosceles triangular sides.

10. An attachment in accordance with claim 9 wherein the apex at which the writing material protrudes has face triangle angles of approximately 30 degrees.

11. An attachment in accordance with claim 1 wherein a particulate or fibrous material is bonded to faces of the polyhedron.

12. An attachment in accordance with claim 1 wherein the polyhedron is a resin polymeric foam.

* * * * *